US007725049B2

(12) United States Patent
Tomatsu et al.

(10) Patent No.: US 7,725,049 B2
(45) Date of Patent: May 25, 2010

(54) IMAGE FORMING APPARATUS HAVING DUCT AND EXHAUST OUTLET

(75) Inventors: Yoshiya Tomatsu, Kasugai (JP); Yohei Hashimoto, Nagoya (JP); Kiyomitsu Kumazawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 203 days.

(21) Appl. No.: 11/949,961

(22) Filed: Dec. 4, 2007

(65) Prior Publication Data

US 2008/0145092 A1 Jun. 19, 2008

(30) Foreign Application Priority Data

Dec. 4, 2006 (JP) ..... 2006-327421

(51) Int. Cl.
*G03G 21/20* (2006.01)

(52) U.S. Cl. ..... 399/93

(58) Field of Classification Search ..... 399/92, 399/93; 361/690, 692, 693, 695; 312/236
See application file for complete search history.

(56) References Cited

U.S. PATENT DOCUMENTS

| | | | | |
|---|---|---|---|---|
| 3,969,785 | A * | 7/1976 | Ogawa et al. | 15/301 |
| 4,093,368 | A * | 6/1978 | Nishikawa | 399/93 |
| 4,938,786 | A * | 7/1990 | Tonomoto | 96/17 |
| 5,946,078 | A * | 8/1999 | Morimoto et al. | 355/30 |
| 6,522,848 | B2 | 2/2003 | Wakana | |
| 7,016,639 | B2 | 3/2006 | Park et al. | |
| 7,313,342 | B2 * | 12/2007 | Katayama et al. | 399/93 |
| 2004/0096229 | A1 | 5/2004 | Yoshihara et al. | |

FOREIGN PATENT DOCUMENTS

| | | | |
|---|---|---|---|
| JP | 63264770 | A * | 11/1988 |
| JP | 03171069 | A * | 7/1991 |
| JP | 06059550 | A * | 3/1994 |
| JP | 08030159 | A * | 2/1996 |
| JP | 09-068901 | | 3/1997 |
| JP | 09-292805 | | 11/1997 |
| JP | 11184335 | A * | 7/1999 |
| JP | 2000250368 | A * | 9/2000 |
| JP | 2000330435 | A * | 11/2000 |
| JP | 2001194967 | A * | 7/2001 |
| JP | 2002018221 | A * | 1/2002 |

(Continued)

*Primary Examiner*—Robert Beatty
(74) *Attorney, Agent, or Firm*—Banner & Witcoff, Ltd.

(57) ABSTRACT

An image forming apparatus which forms an image on a recording sheet includes a housing having an exhaust outlet and an image forming unit disposed in the housing and configured to form an image on a recording sheet. A duct in the housing may have an inlet at a first end in the housing, and communicate with the exhaust outlet at a second end in the housing. The image forming apparatus includes an exhaust fan disposed between the exhaust outlet and the duct, and being configured to cause air entering the duct from the inlet to go toward the exhaust outlet; a first filter disposed in the duct to cover the inlet and being configured to remove dust suspended in the air, and a second filter disposed in the duct downstream from the first filter in a direction of airflow and being configured to remove dust suspended in the air.

20 Claims, 12 Drawing Sheets

FOREIGN PATENT DOCUMENTS

| | | | |
|---|---|---|---|
| JP | 2002-060039 | | 2/2002 |
| JP | 2002-318514 | | 10/2002 |
| JP | 2002318514 A | * | 10/2002 |
| JP | 2004-093708 | | 3/2004 |
| JP | 2005-010751 | | 1/2005 |
| JP | 2005-173350 | | 6/2005 |
| JP | 2006-030631 | | 2/2006 |

* cited by examiner

IMAGE FORMING APPARATUS HAVING DUCT AND EXHAUST OUTLET

CROSS REFERENCE TO RELATED APPLICATION

This application claims priority from Japanese Patent Application No. 2006-327431, filed on Dec. 4, 2006, the entire subject matter of which is incorporated herein by reference.

FIELD

Aspects of the invention relate to an electrophotographic image forming apparatus, such as a tandem-type image forming apparatus.

BACKGROUND

A known electrophotographic image forming apparatus is designed to form an image on a recording sheet by transferring a developer image formed on a developing device, e.g. a photosensitive drum, onto the recording sheet and fixing the transferred image on the recording sheet by heat.

In the electrophotographic image forming apparatus, a great amount of heat is generated by an image forming device including the fixing device and the developing device. Thus, to prevent a temperature of the image forming device from excessively rising, the image forming apparatus includes an exhaust fan configured to discharge hot air from the apparatus.

The image forming apparatus also includes a permeable filter in an exhaust duct for discharging hot air. The permeable filter is configured to prevent dust suspended in air, e.g. developer particles and paper dust, from being discharged along with the hot air.

The permeable filter is configured to remove dust by filtering the air.

To sufficiently remove dust from the hot air, which is discharged from the apparatus, by using a permeable filter, the permeable filter needs to be made of a tight woven fiber such that minute air passages formed in the permeable filter can be decreased in size. However, if the capability of removing dust is improved in this manner, ventilation resistance at which the air passes through the permeable filter will increase.

When the ventilation resistance increases, the amount of air passing through the permeable filter may decrease, a sufficient amount of hot air may not be discharged, and the temperature in the image forming device may excessively rise.

Such problems may be solved with an exhaust fan having a high ventilation capability. However, to increase the ventilation capability, some measures may be taken, e.g., the exhaust fan may be increased in size or a rotational speed of the exhaust fan may be increased.

However, if a larger-sized exhaust fan is used, the image forming apparatus tends to become larger in size. If the rotational speed of the exhaust fan is increased, noise produced by the exhaust fan may become high.

SUMMARY

Aspects of the invention provide an image forming apparatus configured to remove dust from hot air discharged from the apparatus. An image forming apparatus which forms an image on a recording sheet includes a housing having an exhaust outlet and an image forming unit disposed in the housing and configured to form an image on a recording sheet. A duct in the housing may have an inlet at a first end in the housing, and communicate with the exhaust outlet at a second end in the housing. The image forming apparatus includes an exhaust fan disposed between the exhaust outlet and the duct, and being configured to cause air entering the duct from the inlet to go toward the exhaust outlet.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. An image forming apparatus according to aspects of the invention is applied to a laser printer used in connection with a computer in this illustrative embodiment. It will be appreciated that aspects of the invention apply to other types of image forming apparatuses as well.

An appearance of a laser printer 1 will be now described with reference to FIG. 1.

Figure 1:
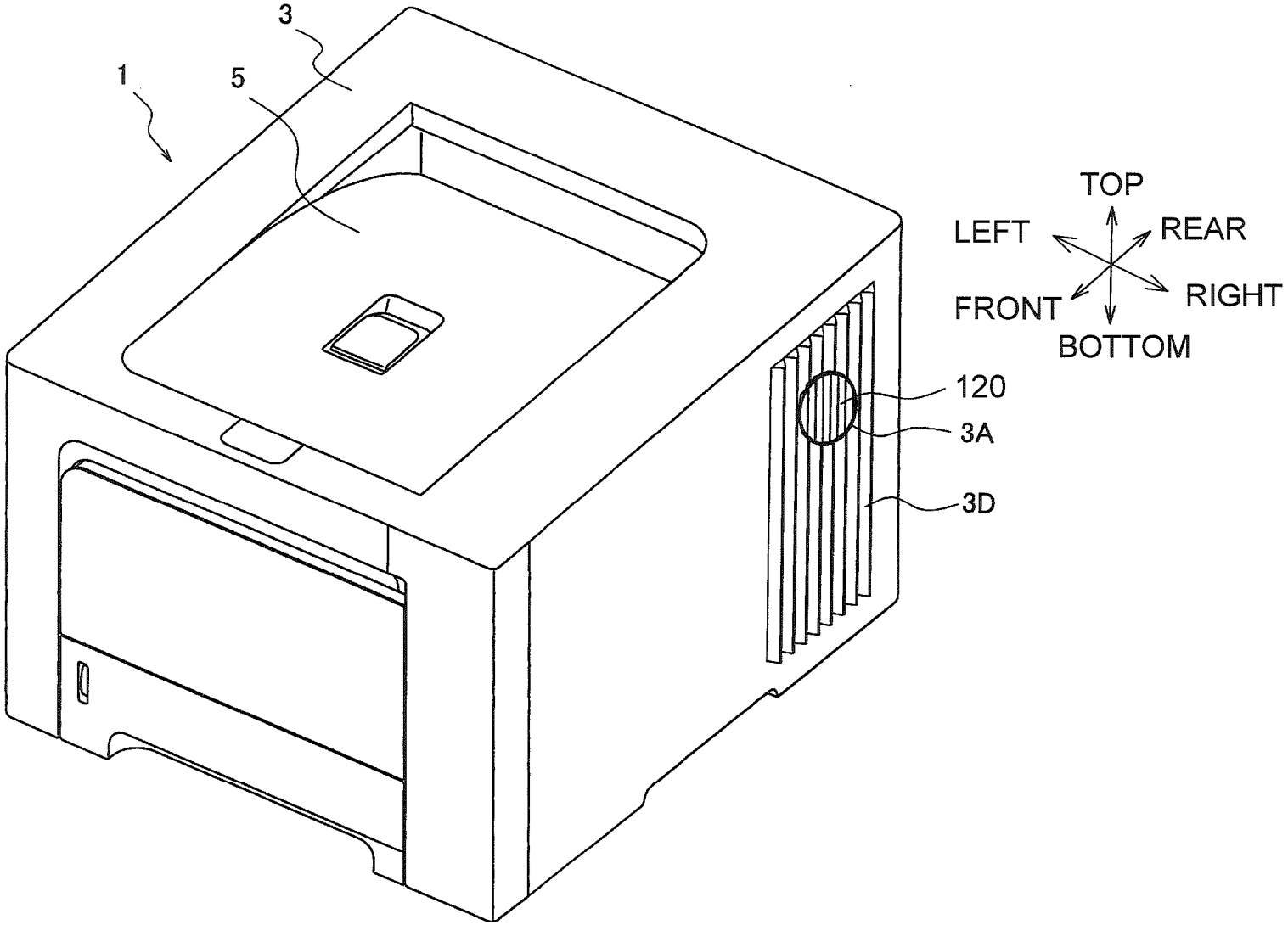
FIG. 1 is a perspective view of a laser printer according to an illustrative embodiment of the invention.

An upper side of FIG. 1 is referred to as the top of the laser printer 1, and the right side of FIG. 1 is referred to as the front side of the laser printer 1. In the following description, top, bottom, rear, and front of objects in the laser printer 1 are used with reference to the arrows in FIG. 1.

Figure 2:
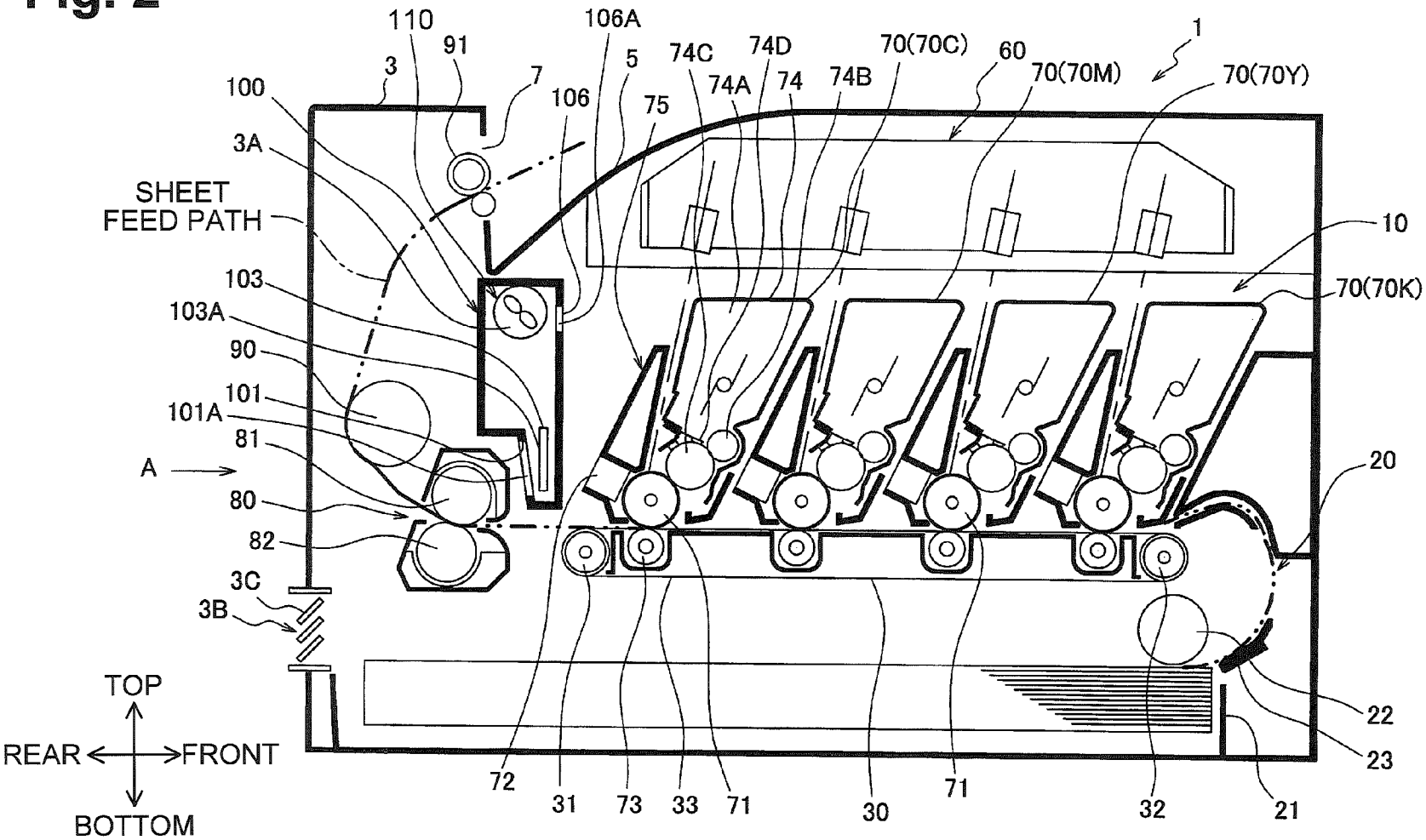
FIG. 2 is a side sectional view of the laser printer.

A housing 3 is provided for an apparatus body of the laser printer 1. A sheet discharge tray 5 may be provided on the top of the housing 3. Printed recording sheets such as plain paper or transparencies may be ejected from the housing 3 and received on the sheet discharge tray 5. An apparatus frame member (not shown) made of metal or resin may be provided in the housing 3. A drawer unit 70 and a fixing unit 80 may be coupled to the apparatus frame member disposed in the housing 3 in a detachable manner as shown in FIG. 2.

An internal structure of the laser printer 1 will be described with reference to FIG. 2.

The laser printer 1 may include an image forming unit 10, a feeder portion 20, and a feed unit 30. The image forming unit 10 is configured to form an image on a recording sheet. The feeder portion 20 may function as a part of a feeding device configured to supply a recording sheet to the image forming unit 10. The feed unit 30 may be configured to feed a recording sheet to four developing cartridges 70K, 70Y, 70M, 70C included in the image forming unit 10.

After an image has been recorded on a recording sheet, an intermediate feed roller 90 and an ejection chute (not shown) may take the recording sheet and feed it upwards towards ejection rollers 91. The ejection rollers 91 may cause the sheet to be ejected from the ejection portion 7 and onto the ejection tray 5.

The feeder portion 20 may include a sheet supply tray 21, a sheet supply roller 22, and a separation pad 23. The sheet supply tray 21 may be disposed in the lowermost part of the housing 3, and may be configured to hold a stack of recording sheets. The sheet supply roller 22 may be disposed at an upper front end of the sheet supply tray 21, and may be configured to supply or feed a recording sheet from the sheet supply tray 21 to the image forming unit 10. The separation pad 23 may be disposed downstream of the sheet supply roller 22 in the direction of the roller's rotation, and may be configured to apply a resistance to separate a topmost sheet from the stack of recording sheets in the sheet supply tray 21. The recording sheet stored in the sheet supply tray 21 makes a u-turn (e.g., is flipped over) at the front side of the housing 3, and is conveyed to the image forming unit 10, which may be centrally disposed in the housing 3.

The feed unit 30 may include a drive roller 31, a driven roller 32, and a conveyor belt 33. The drive roller 31 may be configured to rotate along with an operation in the image forming unit 10. The driven roller 32 may be spaced away from the drive roller 31 and may be configured to rotate. The conveyor belt 33 may be stretched between the drive roller 31 and the driven roller 32.

The drive roller 31 is rotatably supported by a frame (not shown) of the feed unit 30 with a rotating shaft of the drive roller 31 being fixed. The driven roller 32 is rotatably supported by the frame with a rotating shaft of the driven roller 32 being changeable. The driven roller 32 is urged by a deformable member (not shown), e.g. a spring, in a frontward direction to be separated from the drive roller 31 directly or indirectly. This applies a tension to the conveyor belt 33.

The image forming unit 10 may be a direct-tandem type, where color printing is possible. The image forming unit 10 may include a scanner unit 60, the drawer unit 70, and the fixing unit 80.

The scanner unit 60 may be disposed in an upper portion of the housing 3, and may be configured to form electrostatic latent images on corresponding surfaces of photosensitive drums 71 disposed in the four developing cartridges 70K, 70Y, 70M, and 70C, respectively. The scanner unit 60 may include a laser light source, a polygon mirror, fθ lenses and reflecting mirrors.

A laser beam emitted from the laser light source, based on image data, may be deflected by the polygon mirror, pass through the fθ lenses, and be folded by the reflecting mirrors to be directed to a surface of the photosensitive drum 71, on which an electrical latent image is formed.

The drawer unit 70 may include the four developing cartridges 70K, 70Y, 70M, and 70C, and a slider casing 75 that stores the cartridges 70K, 70Y, 70M, and 70C therein. The slider casing 75 may be coupled to the housing 3 so as to move in a horizontal direction, i.e., in a front-rear direction of the laser printer 1 in this illustrative embodiment, while being supported by rails (not shown) disposed in the apparatus frame member of the housing 3.

The four developing cartridges 70K, 70Y, 70M, and 70C may correspond to four color types of developer, such as black, yellow, magenta, and cyan, respectively, and may be arranged in a line along a sheet feeding direction. The developing cartridges 70K, 70Y, 70M, and 70C are configured to transfer a developer image of a corresponding color directly onto a recording sheet.

The four developing cartridges 70K, 70Y, 70M, and 70C may be identical in structure, but with different colors of developer. Thus, in the following description, the structure of the developing cartridges will be described by using the developing cartridge 70C as an example.

The developing cartridge 70C may include a photosensitive drum 71, a charger 72, and a developer storing portion 74 inside.

The photosensitive drum 71 may be configured to carry an image that is to be transferred onto a recording sheet. The photosensitive drum 71 may be cylindrically shaped, and its outermost layer may be a positively charged photosensitive layer made of polycarbonate.

The charger 72 may be configured to charge the surface of the photosensitive drum 71. The charger 72 may be disposed away from the photosensitive drum 71, so as to face the photosensitive drum 71 diagonally rearward from above.

The charger 72 according to this illustrative embodiment may be a scorotron charger that charges the surface of the photosensitive drum 71 uniformly and positively by corona discharge from a charging wire made of tungsten or the like.

A transfer roller 73 may be disposed to face the photosensitive drum 71, and may be configured to rotate along with the rotation of the conveyor belt 33.

Also, the transfer roller 73 may transfer a developer image adhering on the surface of the photosensitive drum 71 to a print surface of the recording sheet by applying an electrical charge, having a polarity (a negative charge in this illustrative embodiment) opposite to an electrical charge of the photosensitive drum 71, to the recording sheet from the bottom side (opposite the print surface) of the recording sheet as it passes by the photosensitive drum 71.

A developer storing portion 74 may include a developer chamber 74A, a developer supply roller 74B, and a developing roller 74C. Developer may be stored in the developer chamber 74A. The developer supply roller 74B and the developing roller 74C may be configured to supply developer to the photosensitive drum 71.

Developer stored in the developer chamber 74A may be supplied to the developing roller 74C along with the rotation of the developer supply roller 74B. The developer supplied to the developing roller 74C may be carried on a surface of the developing roller 74C, regulated to a uniform thickness by a layer thickness regulating blade 74D, and then supplied to the surface of the photosensitive drum 71 that is exposed to light by the scanner unit 60.

The fixing unit 80 may be disposed rearward from the photosensitive drum 71 with respect to the sheet feeding direction, and may be configured to melt developer transferred onto the recording sheet by heat and fix it to the recording sheet. The fixing unit 80 may be removable from the apparatus frame member.

The fixing unit 80 may include a heat roller 81 and a pressure roller 82. The heat roller 81 may be disposed to face the print surface of a recording sheet, and may be configured to apply a feeding force to a recording sheet while heating the developer on the recording sheet. The pressure roller 82 may be disposed to face the heat roller 81 from below, and may be configured to press against the heat roller 81.

The heat roller 81 may be rotated in synchronization with the developing roller 74C and the conveyor belt 33. The pressure roller 82 may receive a rotational force from the heat roller 81 via a recording sheet that is sandwiched between the rollers 81, 82, and rotate by following the rotation of the heat roller 81.

As shown in FIG. 1, an exhaust outlet 3A is disposed in an upper portion on a side of the housing 3. Inside and outside of the housing 3 communicate with each other via the exhaust outlet 3A. Air in the housing 3 is discharged from the exhaust outlet 3A. As shown in FIG. 2, the exhaust outlet 3A is connected to an exhaust duct 100. The exhaust duct 100 is configured to direct air in the housing 3 to the exhaust outlet 3A. The exhaust duct 100 includes a first inlet 101. The first inlet 101 is disposed in a lower portion of the exhaust duct 100, located between the fixing unit 80 and the drawer unit 70, and is opened toward the fixing unit 80.

The first inlet 101 is covered with a first filter 101A. The first filter 101A includes a flat adsorptive surface 101B, which may be electrostatically charged, for collecting dust. The first filter 101A may be disposed such that the adsorptive surface 101B is substantially perpendicular (i.e., within 15 degrees of perpendicular) to the direction of air flowing into the exhaust duct 100 from the first inlet 101. The first filter 101A is a permeable filter through which air flows. The first filter 101A is configured to remove dust from the air by catching the dust (e.g., by using a self-created electrostatic charge) at the adsorptive surface 101B when the air is filtered. The first filter 101A may be a non-woven fabric made from a polypropylene-based material.

Figure 10:
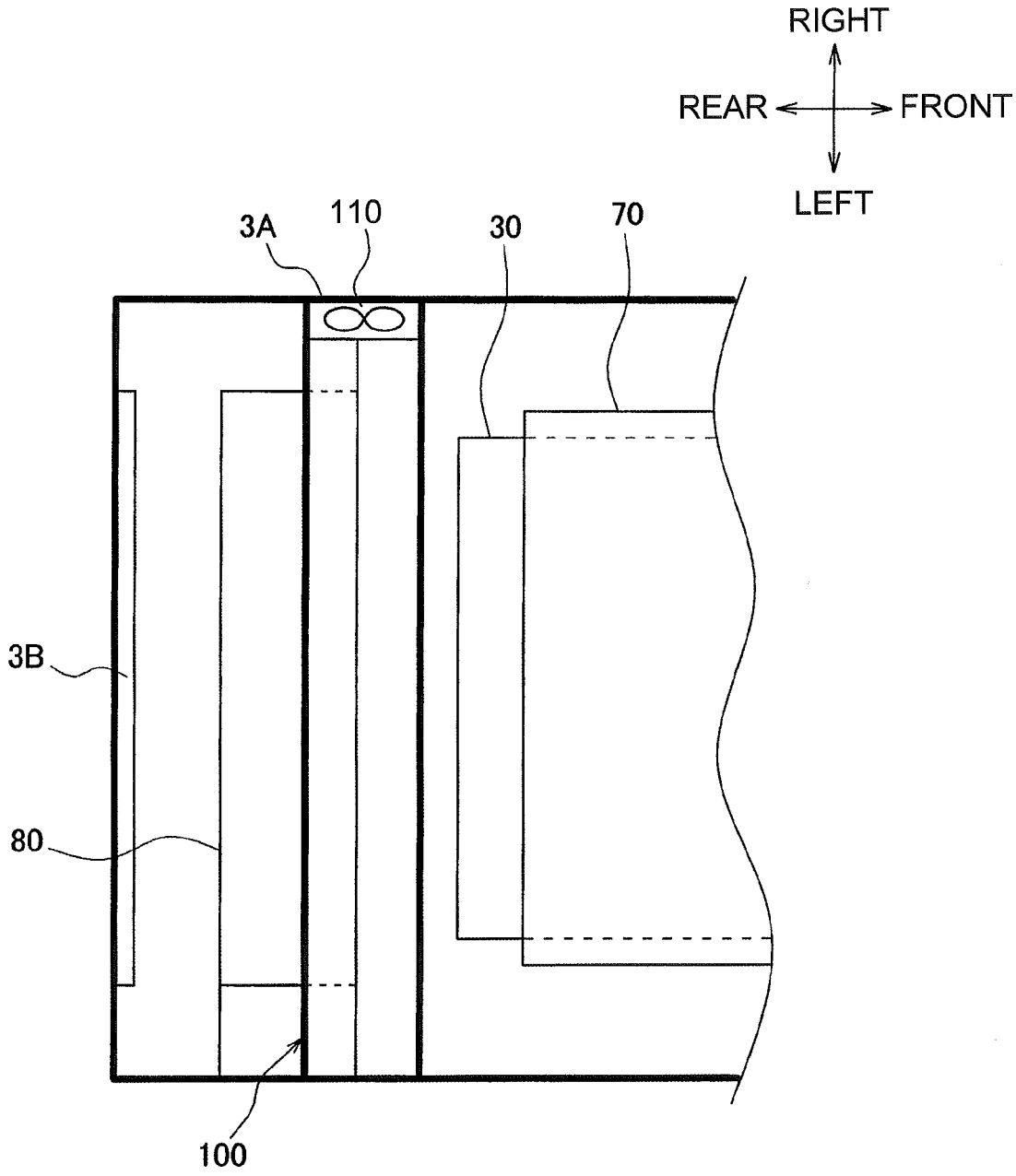
FIG. 10 shows positional relationships of the exhaust duct and drawer unit in the housing viewed from the top.

As shown in FIGS. 2 and 10, the exhaust duct 100 extends in a direction parallel to an axial direction of the drive roller 31 (or a width direction of the laser printer 1), and is located in a space above a sheet feed path in the housing 3 between the fixing unit 80 and the drawer unit 70.

Figure 5:
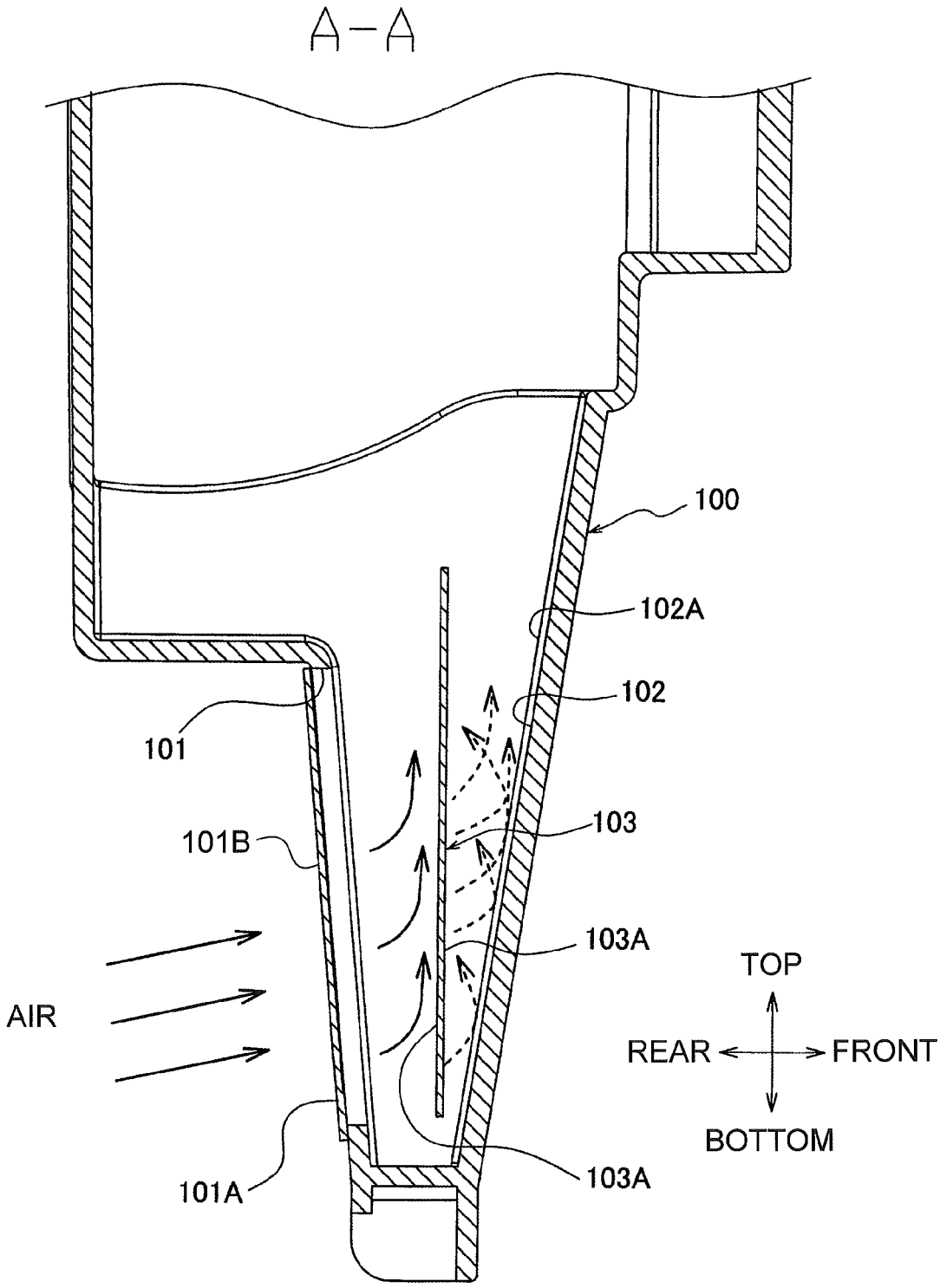
FIG. 5 is a cross-sectional view of the exhaust duct along the line A-A of FIG. 3.

Thus, as shown in FIG. 5, air flowing through the first inlet 101 into the exhaust duct 100 is directed toward a second filter 103 and an inner wall 102 of the exhaust duct 100 disposed toward the drawer unit 70. The air flows upward along the second filter 103 and the inner wall 102 toward the exhaust outlet 3A.

In this illustrative embodiment, the inner wall 102 is inclined with respect to the vertical direction such that an air passage area of the exhaust duct 100 widens toward the exhaust outlet 3A or in an upward direction. This structure reduces pressure loss that is generated when the direction of the air flowing through the first inlet 101 is changed.

The second filter 103 includes flat contact surfaces 103A. The second filter 103 is disposed downstream from the first filter 101A in the direction of airflow in the exhaust duct 100. In addition, the second filter 103 is disposed so that the contact surfaces 103A and the surface 101B of the first filter 101A are disposed in array and face each other. Thus, air flowing through the first filter 101A is received by and contacts the second filter 103. The second filter 103 is a contact-type filter configured to remove dust from air flowing into the exhaust duct 100 by catching the dust at the contact surfaces 103A when the air contacts the contact surfaces 103A.

The air having passed through the second filter 103 goes upward in the exhaust duct 100. The second filter 103 can be positioned in the exhaust duct 100 such that the contact surfaces 103A are parallel to the upward airflow. In other words, the second filter 103 is positioned such that the air, which flows from the left to the right in FIG. 5, just after passing through the first filter 101A, contacts the contact surfaces 103A.

More specifically, the first inlet 101 is open in a direction to take in air substantially horizontally (i.e., within 15 degrees of the front direction in FIG. 5), and the air flowing into the exhaust duct 100 from the first inlet 101 changes its direction approximately 90 degrees upward just after entering the exhaust duct 100. The second filter 103 is disposed such that the contact surfaces 103A are substantially parallel to the airflow direction that has been changed and the width direction of the laser printer 1.

"The contact surfaces 103A are substantially parallel to the airflow" means that macroscopic airflow is parallel to the contact surfaces 103A. As the air contacts the contact surfaces 103A, a large quantity of air contacts the contact surfaces 103A microscopically. As the air contacts the contact surfaces 103A, dust suspended in the air adheres to the contact surfaces 103A due to the momentum caused by the contact. Thus, dust can be removed from the air.

Similar to the first filter 101A, the second filter 103 may be constructed from a non-woven fabric made from a polypropylene-based material. The second filter 103 catches dust by adhesion or adsorption and also filtration by which the air passes through the contact surfaces 103A of the second filter 103.

The second filter 103 may have electrostatic attraction for collecting dust using static electricity generated when the air contacts the second filter 103, and/or may employ ozone absorption using activated carbon.

Figure 9:
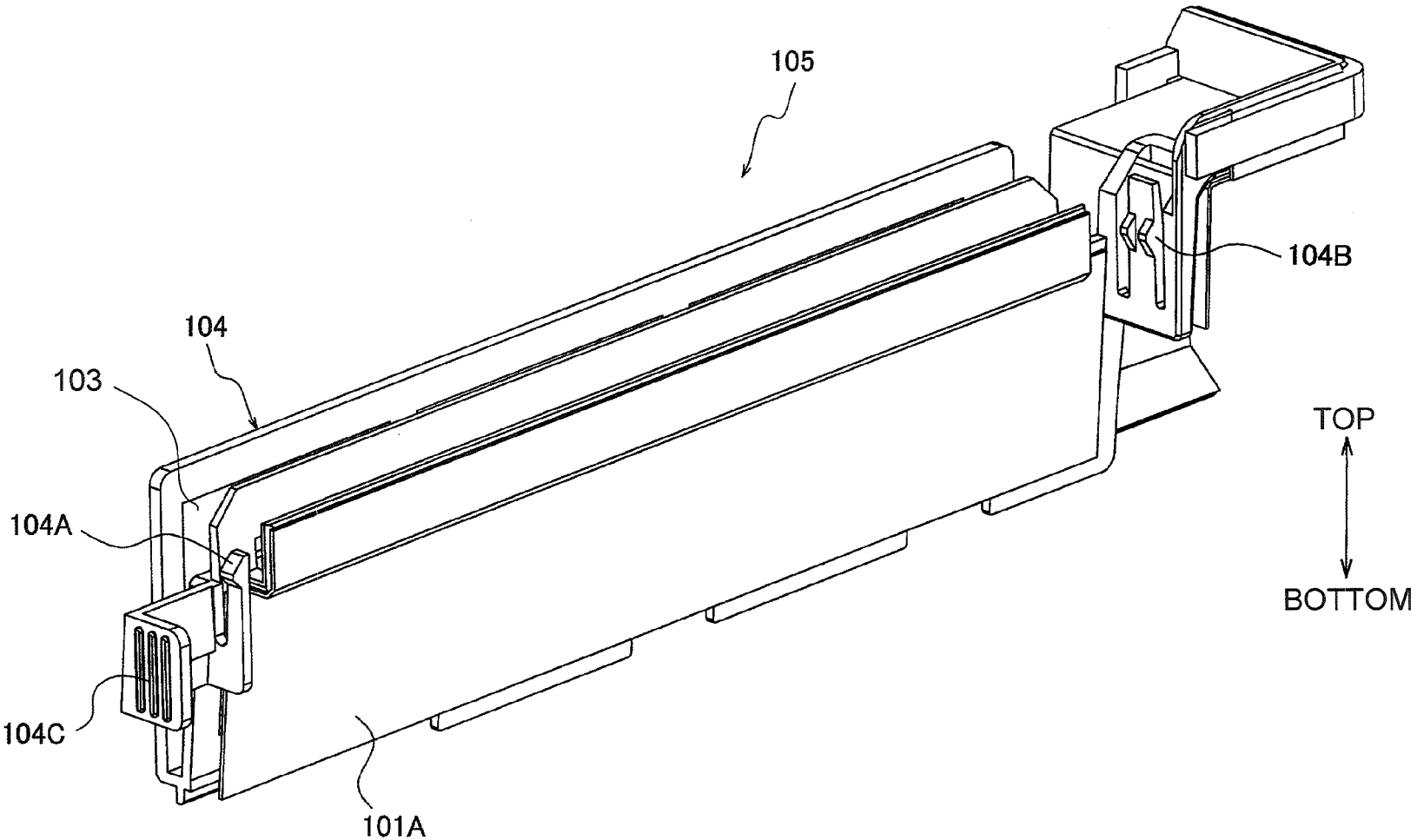
FIG. 9 is a perspective view of the filer unit.

A third filter 102A may be disposed in contact with the inner wall 102. The third filter 102A may be the same contact-type filter as the second filter 103. The first filter 101A and the second filter 103 may be combined via a filter frame 104 as shown in FIG. 9. The filter frame 104 is detachably attached to the exhaust duct 100 via a deformable engaging member. In the following description, the first filter 101A and the second filter 103 integrally formed via the filter frame 104 are collectively referred to as a filter unit 105.

The filter frame 104 is provided with deformable engaging protrusions 104A, 104B. The exhaust duct 100 is provided with recessed portions, not shown, that are engaged with the engaging protrusions 104A, 104B. The filter frame 104 is detachably attached to the exhaust duct 100 via the deformable engaging protrusions 104A, 104B.

The filter unit 105 can be mounted in the exhaust duct 100 as the engaging protrusions 104A, 104B engage in the recessed portions. When a pressing portion 104C is pressed, the engaging protrusions 104A, 104B are deformed and disengaged from the recessed portions, and the filter unit 105 can be removed from the exhaust duct 100.

Figure 3:
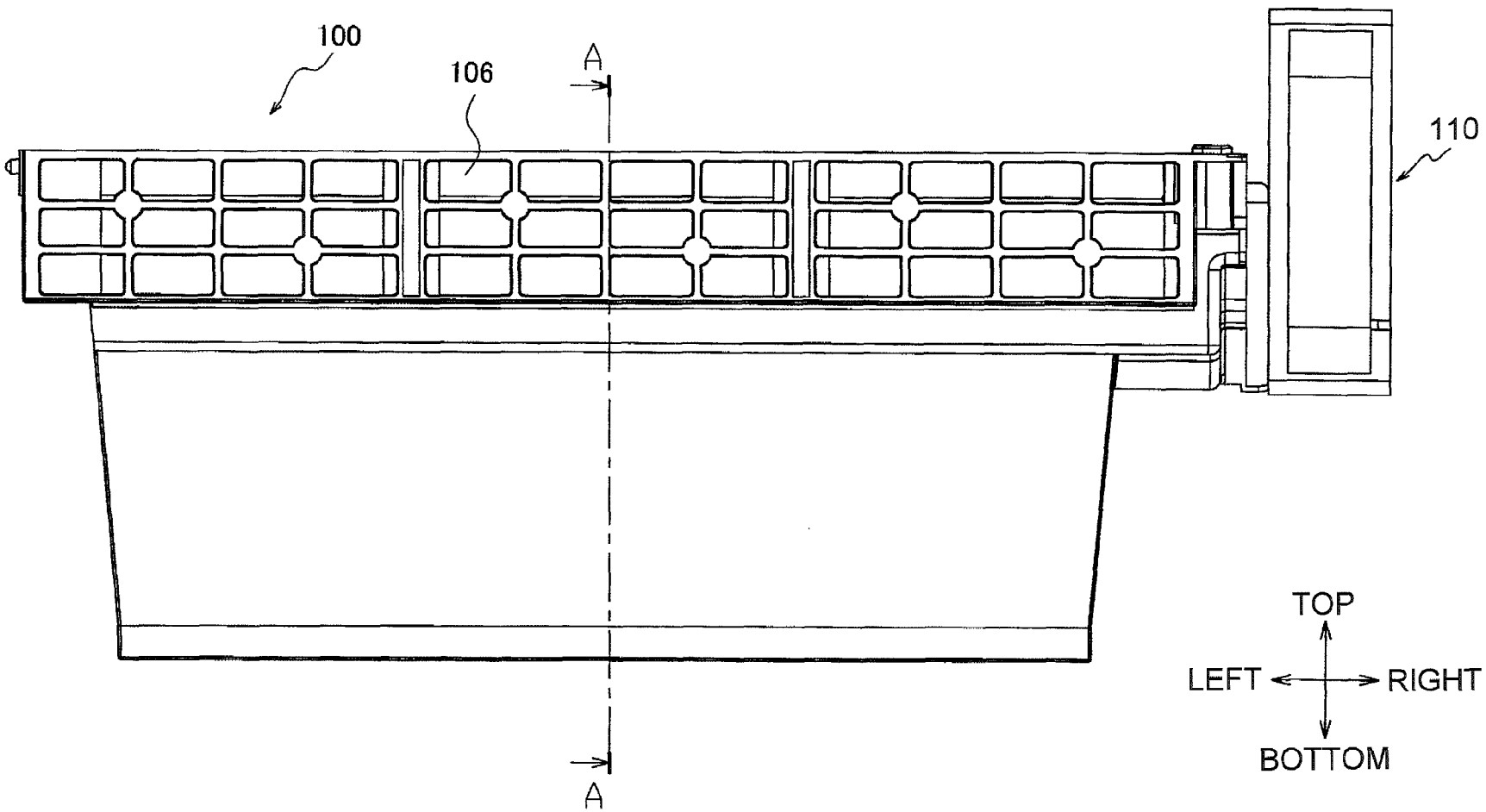
FIG. 3 shows an exhaust duct viewed from a drawer unit.
Figure 4:
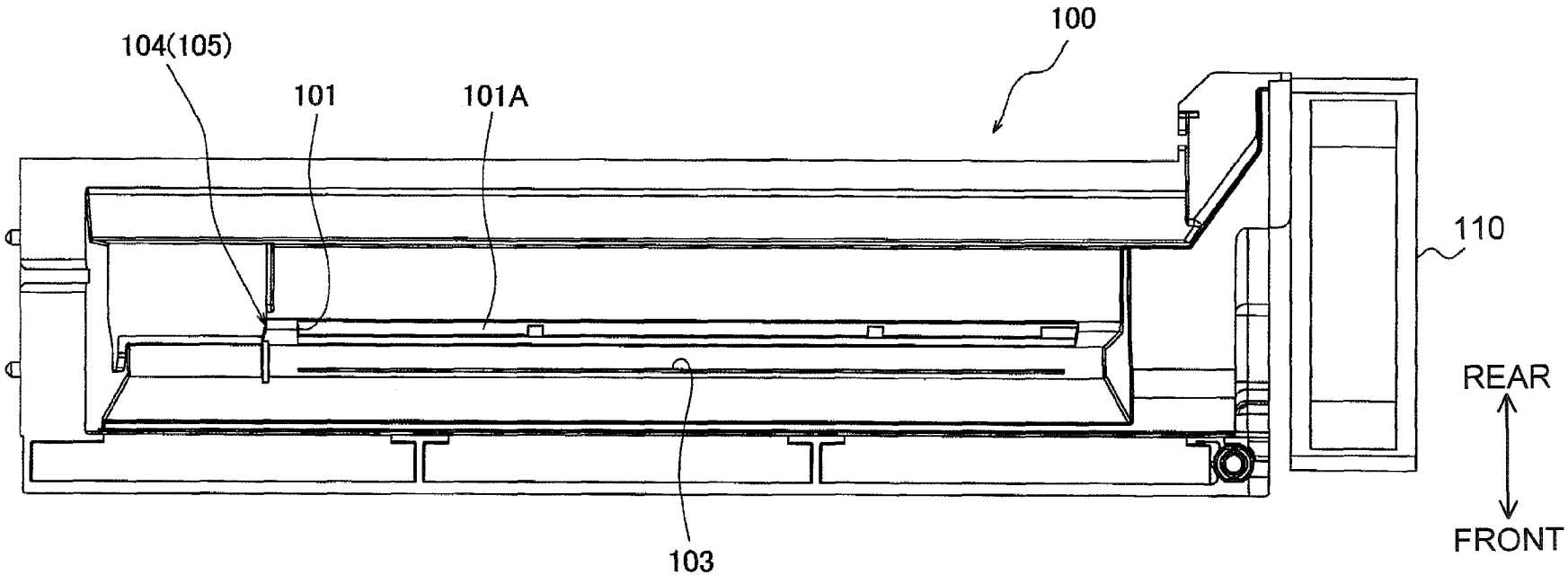
FIG. 4 is a top view of the exhaust duct of FIG. 3.

The exhaust duct 100 is provided with a second inlet 106 in the upper portion as shown in FIG. 2. The second inlet 106 may be formed with a number of openings as shown in FIG. 3. As with the first inlet 101, the second inlet 106 is provided with a fourth filter 106A, which is a permeable filter.

An intake 3B is provided at the rear of the housing 3 as shown in FIG. 2. The intake 3B is disposed to allow the inside and outside of the housing 3 to communicate with each other and take in air for cooling into the housing 3. The intake 3B is provided with slats 3C. The slats 3C are inclined downward from the horizontal direction from the inside to outside of the housing 3.

An exhaust fan 110 is disposed between the exhaust outlet 3A of the housing 3 and the exhaust duct 100. The exhaust fan 110 is configured to cause air entering the exhaust duct 100 from the first inlet 101 or the second inlet 106 to go toward the exhaust outlet 3A. The exhaust fan 110 is constructed of an axial fan which causes air to flow in a direction parallel to a rotating shaft.

Figure 6:
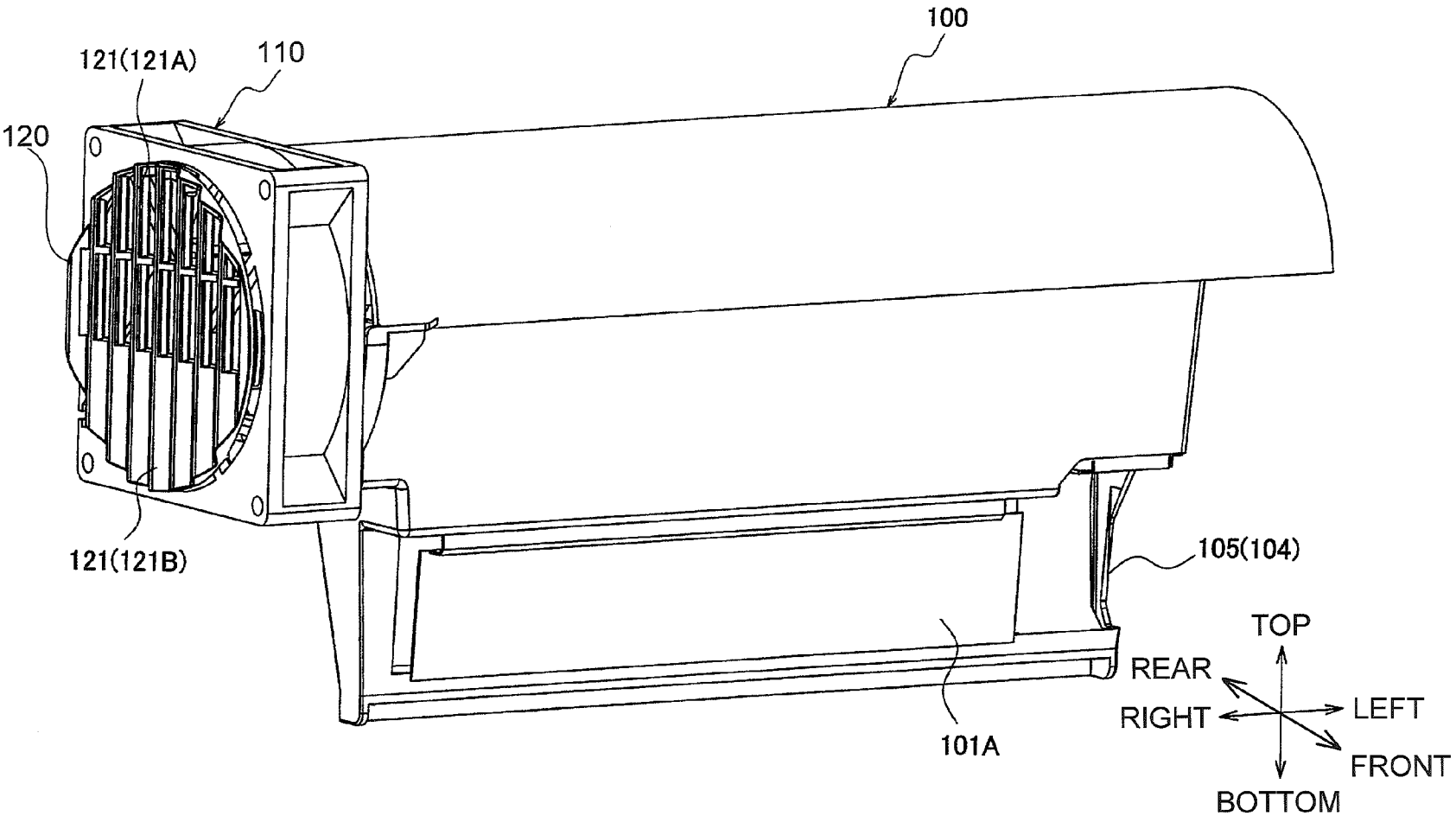
FIG. 6 is a perspective view of the exhaust duct and an exhaust fan.
Figure 7:
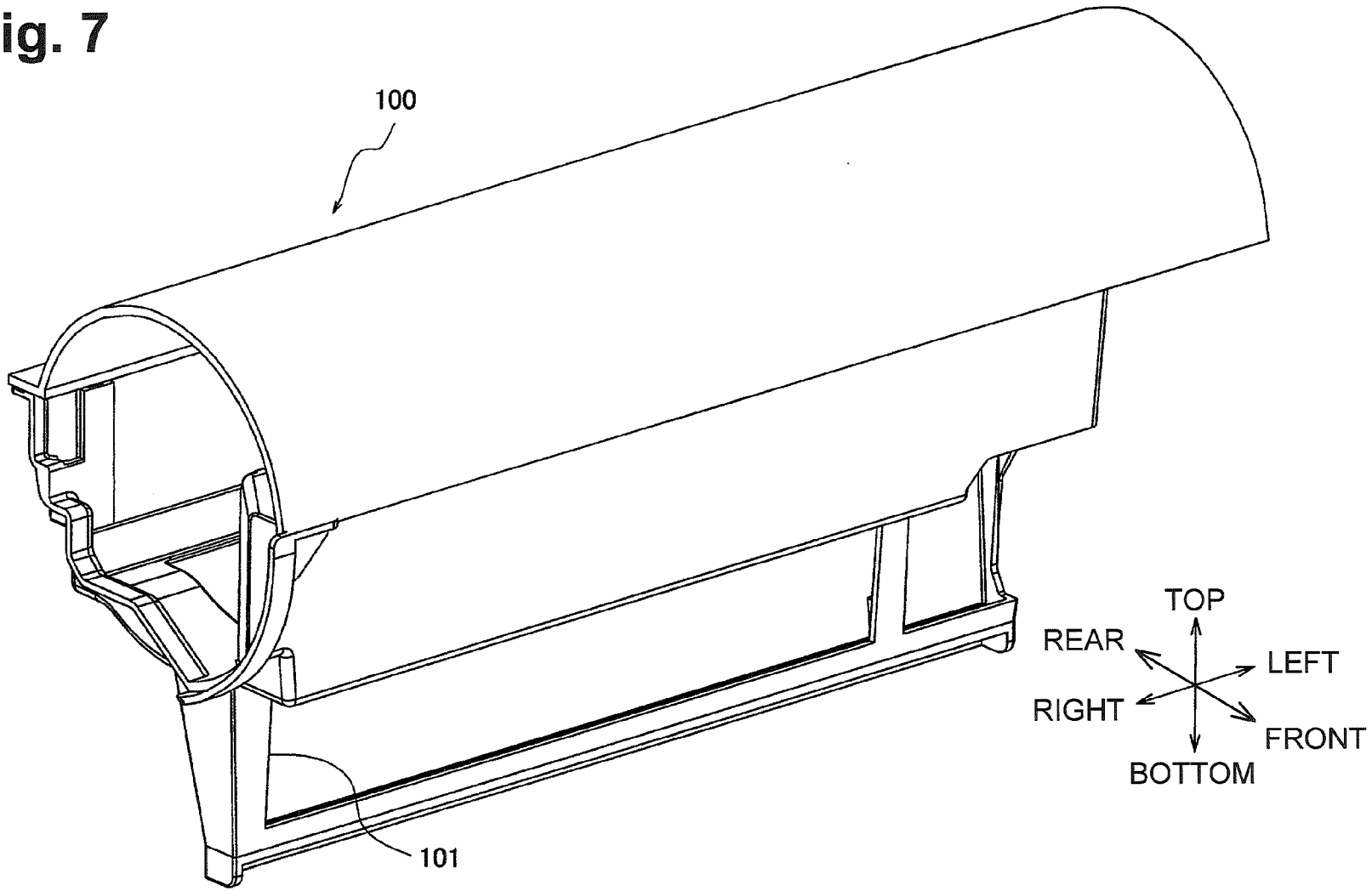
FIG. 7 is a perspective view of the exhaust duct.
Figure 8:
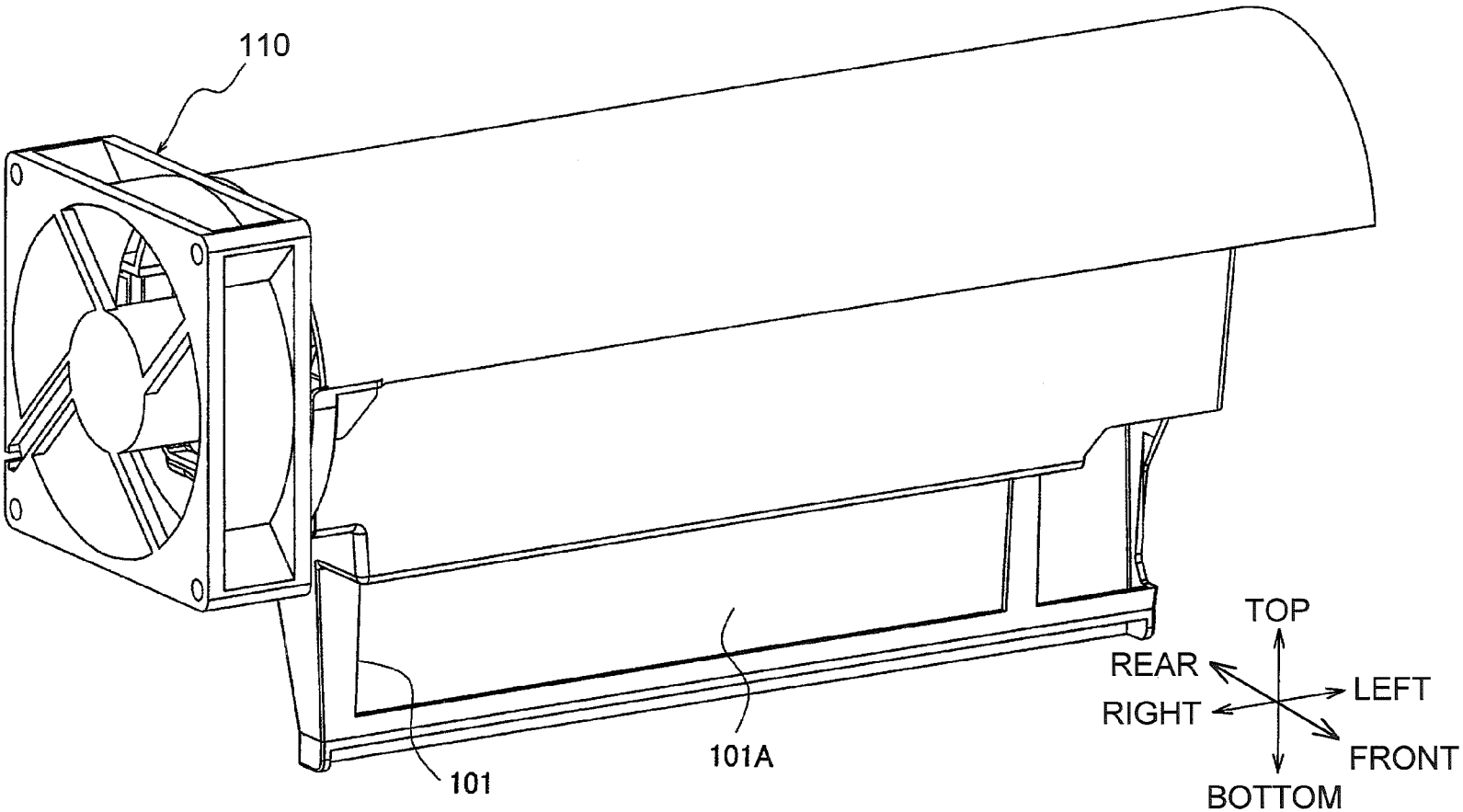
FIG. 8 is a perspective view of the exhaust duct without a filter unit.

The exhaust fan 110 is provided, at an exhaust side, with a louver 120 including fins 121, as shown in FIG. 6. The louver 120 is configured to guide or change airflow from the exhaust fan 110 in at least two different directions.

More specifically, the fins 121 are disposed to guide airflow from the exhaust fan 110 toward a rotational direction (or a tangential direction) of the exhaust fan 110 and to prevent airflow guided in one of the two different directions from colliding with airflow guided in the other direction.

In FIG. 6, the fins 121 are divided into upper fins 121A disposed above a center of rotation of the exhaust fan 110 and lower fins 121B disposed below the center of rotation of the exhaust fan 110. Airflow guided by the upper fins 121A and airflow guided by the lower fins 121B is controlled to avoid collision with each other.

In the louver 120, the upper fins 121A and the lower fins 121B are inclined or slanted in opposite directions with respect to a central portion of the louver 120 in the longitudinal direction or vertical direction in FIG. 6. That is, the upper fins 121A are disposed to guide airflow to the front, while the lower fins 121B are disposed to guide airflow to rear. It will be appreciated that the upper fins 121A and the lower fins 121B may not be divided at the central portion of the louver 120. For example, the upper fins 121A and the lower fins 121B may be divided in an area above or below the central portion of the louver 120.

The louver 120 is mounted to the housing 3 so as to rotate on the center of the rotation of the exhaust fan 110. In FIG. 6, the upper fins 121A guide airflow to the front and the lower fins 121B guide airflow to the rear. However, the directions in which the fins 121 guide the airflow are not limited to the front and rear, as shown in FIG. 6.

The first filter 101A and the second filter 103 can be disposed in an array, in the direction of the airflow, so that their surfaces 101B and 101A face each other. After dust suspended in the air is removed by the first filter 101A, further dust in the air can be removed by the second filter 103. Thus, dust can be sufficiently removed from hot air discharged from the housing 3.

Dust can be removed from the air by two different types of filters, that is, a permeable filter and a contact-type filter, which are disposed in an array so that their surfaces face each other to receive air serially in the direction of the airflow. With the use of the two different types of filters together, increased amounts of dust can be filtered from the air. Thus, there is no need to further reduce in size minute air passages formed in the first filter 101A that is the permeable filter, and the ventilation resistance generated in the first filter 101A can be prevented from increasing.

The second filter 103 is configured to remove dust contained in air contacting the contacting surface 103A and flowing along the contact surface 103A, while the first filter 101A is configured to remove dust in the air when the air flows through the first filter 101A. Thus, the ventilation resistance to be generated in the second filter 103 can be prevented from increasing.

According to the illustrative embodiment, the filters can remove dust, while preventing the ventilation resistance from increasing. Thus, the filters can remove dust from hot air discharged from the housing 3 without having to increase the size and noise of the exhaust fan 110.

The second filter 103 is disposed downstream from the first filter 101A in the direction of the airflow. In addition, the second filter 103 is disposed so that the air just having flowed through the first filter 101A contacts the contact surfaces 103A and the direction that the air flows is changed. Thus, as the air is reliably caused to contact the contact surfaces 103A of the second filter 103, the second filter 103 can catch dust and remove dust from the heat.

As the second filter 103 is disposed so that the air flowing through the first filter 101A contacts the contact surfaces 103A and the direction that the air flows is changed, the ventilation resistance will increase, as compared with a case that the contact surface 103A is disposed parallel to the direction of airflow.

However, the ventilation resistance of the illustrative embodiment is sufficiently small compared to removing dust only with a permeable type filter.

The second filter 103 is not intended to prevent all the air flowing through the contact surface 103A. The second filter 103 includes an air passage that allows some of the air to flow through or permeate the contact surface 103A. Accordingly, the loss of pressure associated with the air contacting the contact surface 103A can be reduced. Thus, dust can be sufficiently removed from the air while the ventilation resistance can be prevented from increasing.

The second filter 103 is made from a non-woven fabric having electrostatic attraction and ozone absorption. Thus, the second filter 103 can be made inexpensively while effectively removing dust from the air.

The first filter 101A and the second filter 103 can be combined and function as the filter unit 105. Thus, the first filter 101A and the second filter 103 can be handled as a single component and easily attached to and removed from the exhaust duct 100.

The second filter 103 also allows air to pass through. The second filter 103 can efficiently remove dust because it can catch the dust by use of both air permeability and through electrostatic adhesion with the contact surface 103A.

The louver 120 is configured to guide airflow from the exhaust fan 110 toward the rotation direction or tangential direction of the exhaust fan 110 and to prevent airflow guided in one of the two different directions from colliding with airflow guided in the other direction. Thus, hot air can be smoothly discharged from the housing 3 without lowering the fan efficiency of the exhaust fan 110. In addition, the louver 120 covers the exhaust fan 110 so as to prevent foreign matter from entering the exhaust fan 110.

In FIG. 6, the length of each fin 121 extends vertically in order to align with protruding ridges 3D extending vertically on the side of the housing 3 as shown in FIG. 1. The fins 121 may extend in a direction (e.g., longitudinal) parallel to each other. To discharge hot air smoothly from the housing 3 without lowering the fan efficiency of the exhaust fan 110, the fins 121 do not need to be arranged so that their length extends vertically. The fins 121 may be arranged so that their length extends horizontally.

A second illustrative embodiment will be described.

The louver 120 according to the first illustrative embodiment is configured to guide airflow from the exhaust fan 110 in two different directions only. The exhaust fan 110, which is an axial fan, cannot guide the entire airflow from the exhaust fan 110 toward the rotation direction or tangential direction of the exhaust fan 110.

Figure 11:
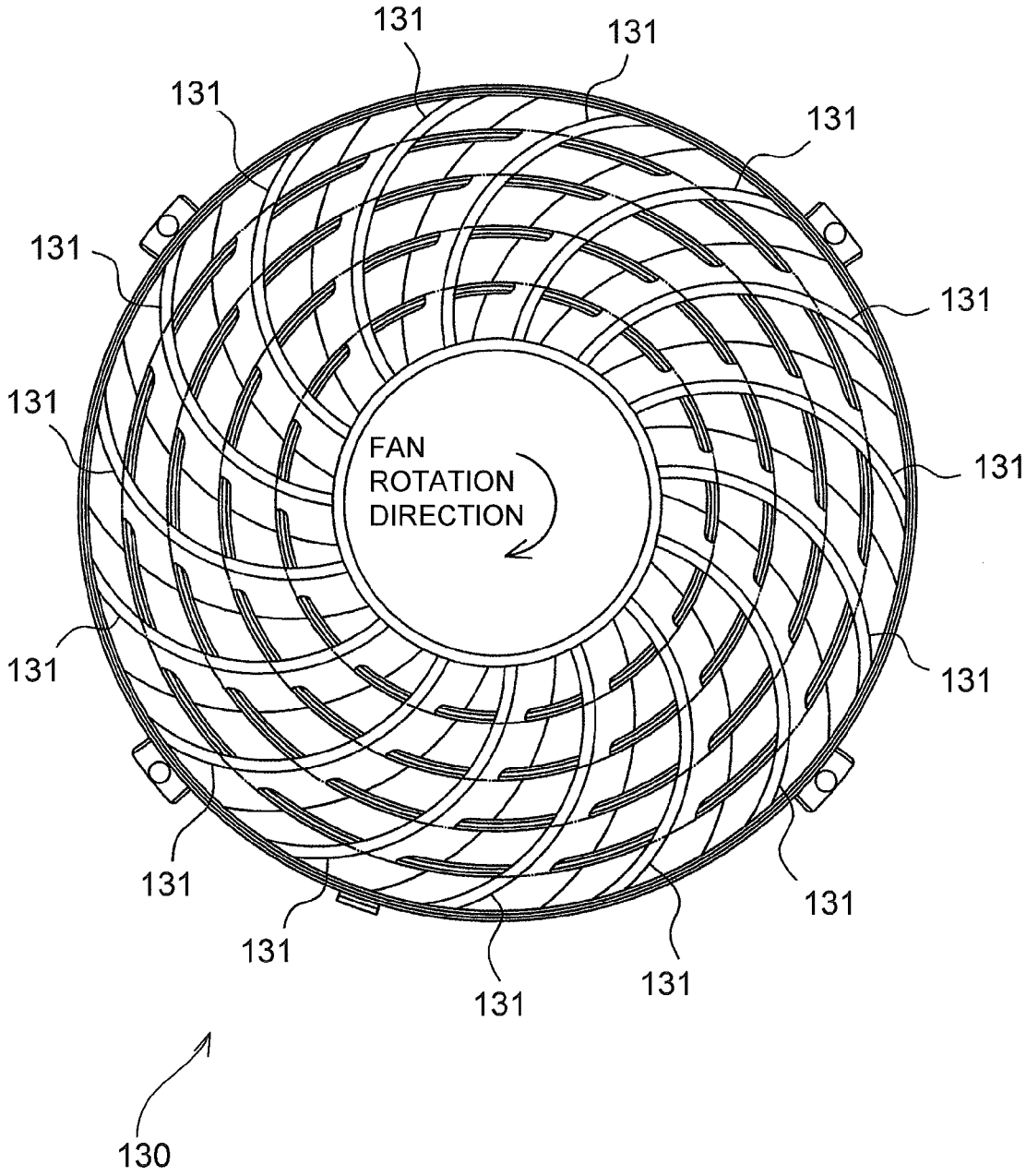
FIG. 11 is a front view of a louver according to a second illustrative embodiment of the invention.
Figure 12:
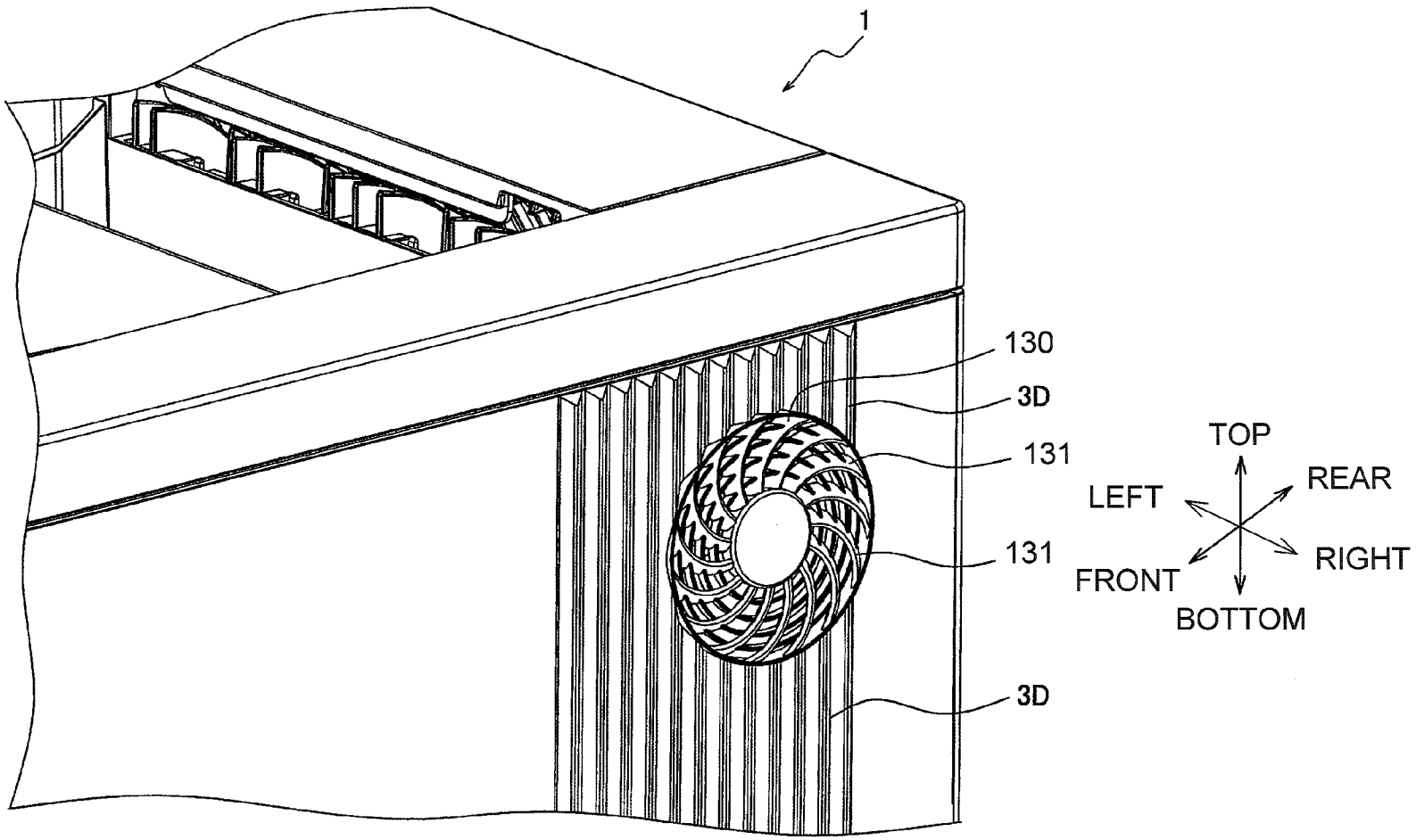
FIG. 12 is a perspective view of a housing containing the louver.

In the second illustrative embodiment, a louver 130 includes fins 131 that are spirally shaped like blades of a centrifugal multi-blade fan or a centrifugal pump as shown in FIGS. 11 and 12. This structure allows the entire airflow from the exhaust fan 110 to be guided toward the rotational direction or tangential direction of the exhaust fan 110.

Thus, hot air can be smoothly discharged from the housing 3 by increasing the fan efficiency of the exhaust fan 110. In addition, the louver 130 covers the exhaust fan 110 so as to prevent foreign matter from entering the exhaust fan 110.

The first filter 101A, the second filter 103, and the third filter 102A can be constructed from a non-woven fabric made from a polypropylene-based material. However, the filters may be constructed from a non-woven or woven fabric made from another material, e.g., polyester, polyethylene terephthalate, nylon, cellulose, glass fiber, or metal. Each filter may be constructed from a different material.

The first filter 101A, the second filter 103, and the third filter 102A may be multilayer filters. A multi-layer filter can be constructed from a combination of a filter of coarse and robust mesh and a filter of fine, soft, non-woven fabric. With this configuration, the filter of coarse and robust mesh can maintain the entire strength, and the filter of fine, soft, non-woven fabric can efficiently catch dust, e.g. toner particles.

The exhaust fan 110 can be disposed at one side of the exhaust duct 100 with respect to the width of the exhaust duct 100 or the axial direction of the drive roller 31. However, the exhaust fan 110 may be disposed at each side of the exhaust duct 100.

The exhaust fan 110 is an axial fan. However, the exhaust fan 110 may be another type of fan, e.g. a centrifugal multi-blade fan such as a turbo fan and a sirocco fan, and a cross-flow fan.

The third filter 102A may be disposed on the inner wall 102. However, it is sufficient if the permeable filter (the first filter 101A) and at least one contact-type filter are disposed in an array so that their surfaces face each other in the direction of the airflow. The second filter 103 or the third filter 102A may be omitted. The second filter 103 or the third filter 102A may be disposed upstream from the first filter 101A. Two or more second filters 103 may be disposed in an array so that their surfaces face each other to receive air serially in the direction of airflow. Also, the second filters may be disposed in parallel to receive air in the direction of airflow concurrently. Also, certain second filters 103 may be disposed in parallel to receive air in the direction of airflow concurrently with those certain filters 103 being in series with one or more other second filters 103 in the direction of airflow.

If at least one of the first filter 101A, the second filter 103, and the third filter 102A is fluffy, noise can be absorbed when air is blown toward the exhaust duct 100. In this case, the length of fibers can be about 1-3 mm.

The direction of airflow is changed approximately 90 degrees just after the air passes through the first filter 101A. It will be appreciated that the change in direction of airflow is not limited to 90 degrees. However, instead of changing the direction of airflow just after the air passes through the first filter 101A, the first inlet 101 may be opened downward and the contact surface 103A of the second filter 103 may be disposed parallel to the direction of the airflow.

The position of the exhaust duct 100 is not limited to the position shown in FIG. 2. The exhaust duct 100 may be disposed in other positions.

The second filter 103 applies electrostatic attraction using static electricity, and ozone absorption using activated carbon. However, the second filter 103 may be electrically charged to exert electrostatic attraction. Alternatively, the second filter 103 may not apply either electrostatic attraction or ozone absorption.

The first filter 101A and the second filter 103 can be combined via the filter frame 104. However, these filters may be attached to and detached from the exhaust duct 100 independently. Alternatively, the first filter 101A, the second filter 103, and the third filter 103A may be combined.

While the features herein have been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the features disclosed herein. It is intended that the specification and the described examples are illustrative only with the true scope of the invention being defined by the following claims.

What is claimed is:

1. An image forming apparatus configured to form an image on a recording sheet by transferring a developer image onto the recording sheet, the apparatus comprising:

a housing having an exhaust outlet;

an image forming unit disposed in the housing and configured to form an image on a recording sheet;

a duct disposed in the housing, the duct having an inlet at a first side and a wall at a second side opposite to the first side, and the duct communicating with the exhaust outlet;

an exhaust fan disposed between the exhaust outlet and the duct, the exhaust fan being configured to cause air entering the duct from the inlet to go toward the exhaust outlet;

a first filter which covers the inlet, the first filter being configured to remove dust suspended in the air; and a second filter disposed between the first filter and the wall such that the first filter and the second filter form a first air passage and the second filter and the wall form a second air passage, the first air passage being configured to guide air, which has passed through the first filter, toward the exhaust outlet such that the air is able to reach the exhaust outlet without passing through the second filter, the second air passage being configured to guide air, which has passed through both the first and second filters toward the exhaust outlet, the second filter being configured to remove dust suspended in the air.

2. The image forming apparatus according to claim 1, wherein the second filter is configured to face the first filter to receive the air serially in the direction of the airflow.

3. The image forming apparatus according to claim 1, further comprising a filter frame which includes a combination of the first filter and the second filter.

4. The image forming apparatus according to claim 3, wherein the filter frame is configured to be attached to and removed from the inlet of the duct.

5. The image forming apparatus according to claim 1, wherein the first filter is configured to remove dust from the air using electrostatic attraction.

6. The image forming apparatus according to claim 1, wherein the second filter is configured to remove dust from the air using electrostatic attraction.

7. The image forming apparatus according to claim 6, wherein the first filter is configured to remove dust from the air using electrostatic attraction.

8. The image forming apparatus according to claim 1, wherein the second filter is further configured to remove dust from the air using ozone absorption.

9. The image forming apparatus according to claim 1, wherein the first filter and the second filter include a non-woven fabric.

10. The image forming apparatus according to claim 9, wherein the non-woven fabric includes a polypropylene-based material.

11. The image forming apparatus according to claim 1, further comprising a louver disposed at an exhaust side of the exhaust fan, the louver having a first set of fins and a second set of fins, the first set of fins being inclined in a first direction and the second set of fins being inclined in a second direction opposite the first direction.

12. The image forming apparatus according to claim 11, wherein the first and second set of fins are configured to be parallel with each other in a longitudinal direction.

13. The image forming apparatus according to claim 1, fun her comprising a louver disposed at an exhaust side of the exhaust fan, the louver including a plurality of spirally shaped fins configured to guide the airflow from the exhaust fan in a rotational direction of the exhaust fan.

14. The image forming apparatus according to claim 1, further comprising a third filter configured to remove dust suspended in the air that has passed through the second filter.

15. The image forming apparatus according to claim 1, further comprising a fixing unit configured to fix the image on the recording sheet thermally, wherein the first filter is disposed facing the fixing unit.

16. A method of discharging air from a housing for an image forming apparatus configured to form an image on a recording sheet, the image forming apparatus including an exhaust outlet, a duct having an inlet at a first side and a wall at a second side opposite to the first side, a first filter covering the inlet, and a second filter disposed between the wall and the first filter, the method comprising:

guiding air to enter the duct and pass through the first filter;

guiding a first volume of the air to pass through a first air passage between the first filter and the second filter toward the exhaust outlet such that the first volume of the air is able to reach the exhaust outlet without passing through the second filter;

guiding a second volume of the air to pass through the second filter and through a second air passage between the second filter and the wall of the duct and toward the exhaust outlet;

removing dust suspended in the air with the first filter; and removing dust suspended in the second volume of the air with the second filter.

17. The method of claim 16, further comprising guiding air through a first portion of the exhaust outlet in a first direction and through a second portion of the exhaust outlet in a second direction opposite the first direction.

18. The method of claim 16, wherein the removing dust with the first and second filters includes removing dust from the air using electrostatic attraction.

19. The method of claim 18, wherein the removing dust with the second filter includes using ozone absorption.

20. A method of discharging air from a housing for an image forming apparatus configured to form an image on a recording sheet, the method comprising:

causing air to enter a duct at an inlet and pass through a first filter covering the inlet and a second filter downstream from the first filter and be directed toward an exhaust outlet;

removing dust suspended in the air with the first filter;

removing dust suspended in the air that has been passed through the first filter with the second filter; and guiding air through the exhaust outlet in a rotational direction of an exhaust fan.

* * * * *

UNITED STATES PATENT AND TRADEMARK OFFICE

CERTIFICATE OF CORRECTION

PATENT NO. : 7,725,049 B2
APPLICATION NO. : 11/949961
DATED : May 25, 2010
INVENTOR(S) : Yoshiya Tomatsu et al.

It is certified that error appears in the above-identified patent and that said Letters Patent is hereby corrected as shown below:

Column 11, Claim 13, Lines 4 and 5:
Please delete "fun her" and insert --further--.

Signed and Sealed this

Twenty-third Day of November, 2010

David J. Kappos

David J. Kappos
*Director of the United States Patent and Trademark Office*